US008813821B2

(12) United States Patent
Lafurge, Jr.

(10) Patent No.: US 8,813,821 B2
(45) Date of Patent: Aug. 26, 2014

(54) AEROSPACE SAND CASTING SUPPORT

(71) Applicant: Robert E. Lafurge, Jr., Byron, IL (US)

(72) Inventor: Robert E. Lafurge, Jr., Byron, IL (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 0 days.

(21) Appl. No.: 13/706,034

(22) Filed: Dec. 5, 2012

(65) Prior Publication Data

US 2014/0150983 A1 Jun. 5, 2014

(51) Int. Cl.
*B22C 9/10* (2006.01)
*B22C 21/14* (2006.01)

(52) U.S. Cl.
USPC ..... 164/340; 164/30; 164/366; 164/399

(58) Field of Classification Search
USPC ..... 164/340, 366, 397–400
See application file for complete search history.

(56) References Cited

U.S. PATENT DOCUMENTS

| | | | | |
|---|---|---|---|---|
| 1,403,467 | A * | 1/1922 | Courtot | 164/399 |
| 2,096,679 | A * | 10/1937 | Gibson | 164/399 |
| 2,560,258 | A * | 7/1951 | Snyder et al. | 164/370 |
| 2,985,930 | A * | 5/1961 | Hohlfelder, Jr. | 164/398 |
| 2010/0139586 | A1 * | 6/2010 | Nakamura et al. | 123/90.6 |

* cited by examiner

*Primary Examiner* — Keith Walker
*Assistant Examiner* — Kevin E Yoon
(74) *Attorney, Agent, or Firm* — Cantor Colburn LLP

(57) ABSTRACT

A component casting apparatus includes a mold to receive a molten solid for casting a component. The mold includes a first sacrificial layer to define a housing of the component and a second sacrificial layer to form at least one core passage of the component in response to contact from the molten solid. The component casting apparatus further includes a trusset disposed against an outer surface of the second sacrificial layer and formed from metal to support the second sacrificial layer.

10 Claims, 6 Drawing Sheets

AEROSPACE SAND CASTING SUPPORT

BACKGROUND

Embodiments of the disclosure relate generally to an aerospace sand casting support system, and more specifically, a casting system that supports one or more core structure utilized in a casting process.

Sand castings have been traditionally utilized by the aerospace industry to manufacture components that have complex lubrication or fuel transfer systems. Conventional sand castings include one or more core structures, for example sand cores, having a predetermined diameter. The sand cores form corresponding core passages having a hollow region defined by a predetermined diameter of the sand core. FIG. 1, for example, illustrates a traditional aerospace industrial electrical generator 10 fabricated according to a conventional sand casting process. The electrical generator 10 includes a housing 12. A core passage network 14 is illustrated in phantom as being disposed inside the housing 12. The core passage network 14 includes a plurality of core passages 16.

The core passages 16 may span long distances within the housing 12, while also changing elevations or centerlines, and transitioning in shape or diameter. The conventional sand casting process forms the core passages 16 using compressed sand cores (not shown) to define the inner diameter, i.e., volume, of the core passages 16. Thereafter, molten metal is poured over the sand cores. The molten metal hardens around the sand cores to form exterior walls of the core passages 16, while the heat from the molten metal reduces the sand cores to loosen sand that is flushed from within the core passages. To maintain dimensional stability and location of the core passages 16, conventional sand casting processes utilize numerous sand prints, i.e., core supports 18. The core supports 18 are then subsequently welded shut during the post cast processing at the foundry level.

The welding process used during the conventional casting process must seal the core supports 18 adequately to prevent fluid leak paths, which can expose the casted component to flammable conditions. To ensure the leak paths are sealed, the welding work requires extensive preparation, mandated inspection processes, and rework cycles impacting both quality and delivery of the casted component. In large casting components, for example, twenty or more plug welds may exist, which increases costs, metal scrap, and delays component development. In addition, the welding process may cause residual stresses in the component that are exposed in subsequent manufacturing processes.

SUMMARY

According to an embodiment, a component casting apparatus includes a mold to receive a molten solid for casting a component. The mold includes a first sacrificial layer to define a housing of the component and a second sacrificial layer to form at least one core passage of the component in response to contact from the molten solid. The component casting apparatus further includes a trusset disposed against an outer surface of the second sacrificial layer and formed from metal to support the second sacrificial layer.

According to another embodiment, a component casted by a casting process comprises a housing having an interior space. The housing is formed in response to a molten metal contacting a first sacrificial layer. The component includes a core passage formed in the interior space in response to contacting the molten metal against a second sacrificial layer having a first diameter. The core passage includes a passage wall and a hollow region formed therethrough. The component further includes a trusset integrally formed with the passage wall in response to contact from the molten metal to support the core passage.

In yet another embodiment, a trusset to support a core structure having radius and length extending perpendicular to the radius comprises a frame extending in a direction perpendicular to the length of the core structure. The frame includes an upper portion to contact an outer surface of the core structure, and a lower portion to contact a sacrificial layer of a mold.

In still another embodiment, a method of casting a component including a core passage comprises forming at least one core structure having a predetermined diameter for defining a hollow region of the core passage. The method further includes coupling a trusset to an outer surface of the core structure and covering the core structure and the trusset with a molten solid to melt the trusset. The method further comprises solidifying the molten metal and the melted trusset to form the core passage such that trusset is integrally formed thereto.

BRIEF DESCRIPTION OF THE DRAWINGS

The subject matter of the disclosure is particularly pointed out and distinctly claimed in the claims at the conclusion of the specification. The foregoing and other features of the various embodiments are apparent from the following detailed description taken in conjunction with the accompanying drawings in which:

DETAILED DESCRIPTION

Figure 1:
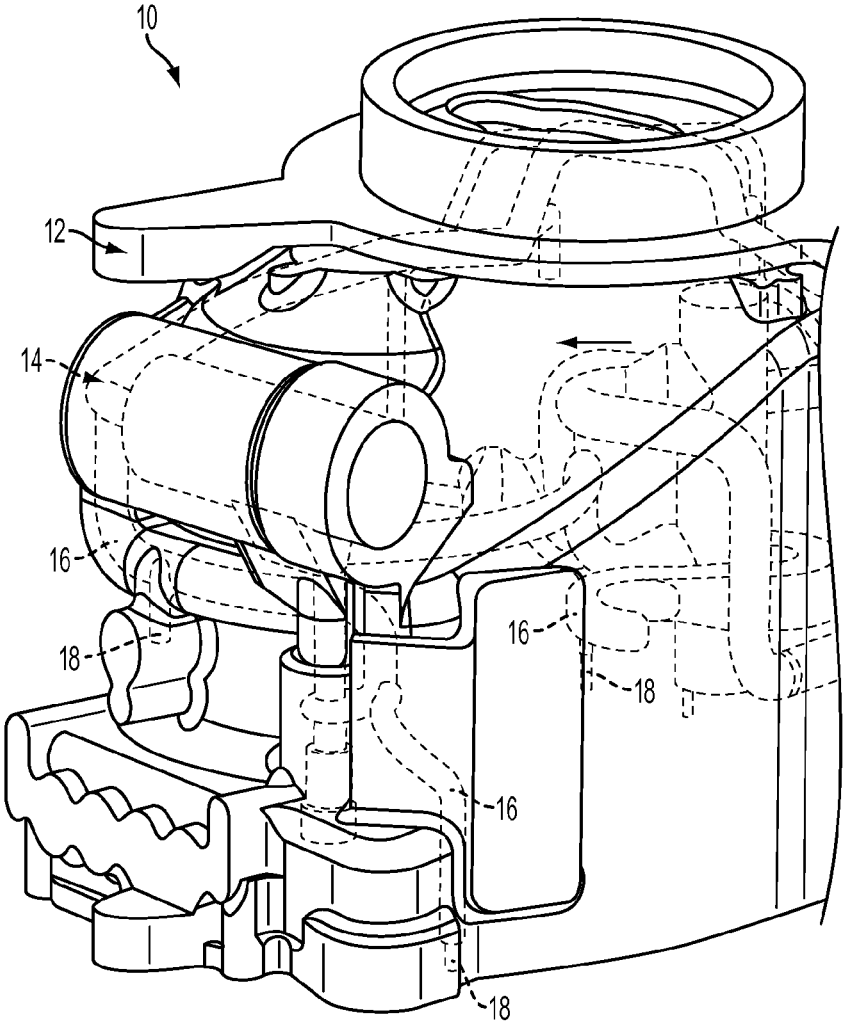
FIG. 1 illustrates an electrical generator showing the generator housing in phantom and a plurality of core passages formed within the housing according to a conventional casting process.
Figure 2:
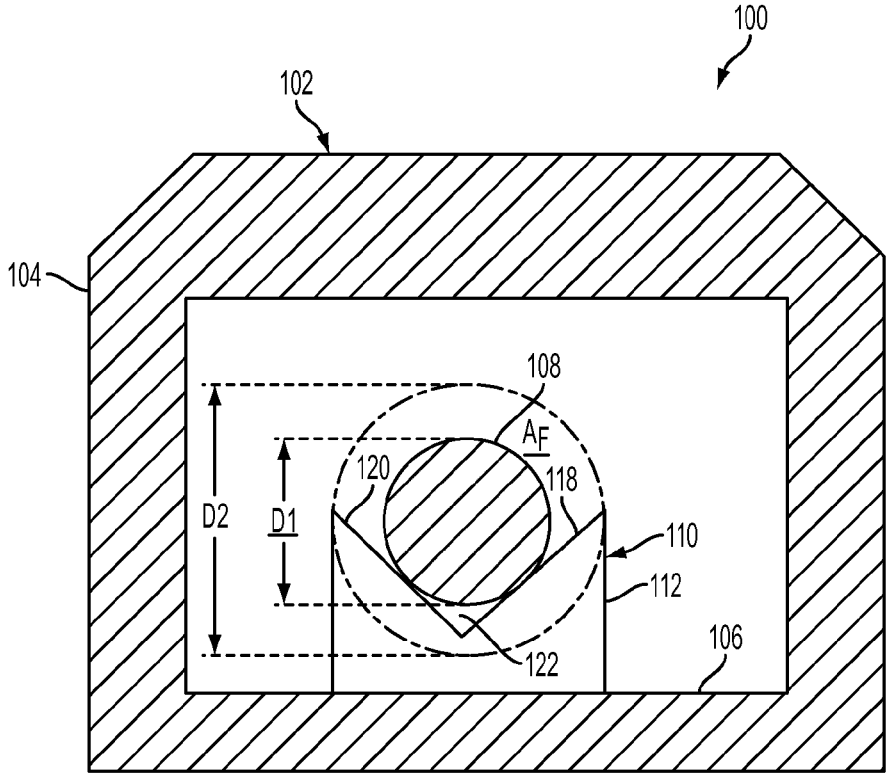
FIG. 2 illustrates a component casting apparatus including a trusset according to an embodiment of the disclosure.

Referring now to FIG. 2, a component casting apparatus 100 is illustrated according to an embodiment. The component casting apparatus includes a mold 102 including a mold body 104 to define a housing of a component to be cast (not shown). A first sacrificial layer 106 and a second sacrificial layer 108 are formed within the mold body 104. The first and second sacrificial layers 106, 108 may be formed from, for example, compressed sand. The first sacrificial layer 106 is disposed in the mold body 104 and takes the shape thereof. In addition, the first sacrificial layer 106 defines the inner volume of the component to be casted. That is, the first sacrificial layer 106 is removed in response to a casting process, thereby leaving an exterior housing wall that surrounds a hollowed region defining an interior volume. In one embodiment, the casting process includes introducing a molten metal including, but not limited to, molten magnesium and molten aluminum, into the mold body 104. The molten magnesium may have temperature of about 650 degrees Celsius (° C.) (1202 degrees ° F.) to about 700 degrees ° C. (1292° F.), and the molten aluminum may have a temperature of about 660.3 degrees ° C. (1220.7° F.) to about 800 degrees ° C. (1472° F.).

The second sacrificial layer 108 is surrounded by the first sacrificial layer 106, and extends along one or more directions within the mold body 104. The second sacrificial layer may be formed as a sand core, for example. The sand core may act as a core structure to define one or more core passages (not shown) that are casted using a casting process described in greater detail below. The first and second sacrificial layers 106, 108 define a metal fusing area ($A_F$) between one another to receive the molten metal, which covers the first and second sacrificial layers 106, 108 during the casting process. As discussed above, the second sacrificial layer 108 may be formed as a sand core having a first diameter ($D_1$) that defines an inner volume of a core passage to be formed. Similar to the first sacrificial layer 106, the second sacrificial layer 108 is removed in response to the casting process thereby forming a passage wall (not shown) of the core passage. The passage wall has a second diameter ($D_2$), i.e., an outer diameter, which is greater than the first diameter ($D_1$), i.e., inner diameter, of the core passage formed using the second sacrificial layer 108, i.e., the sand core. Accordingly, the core passage may be formed within the housing of the component after the casting process is performed as described in greater detail below.

The component casting apparatus 100 further comprises a trusset 110 to support the second sacrificial layer 108, i.e., the sand core. In at least one embodiment, the trusset 110 is disposed between the first and second sacrificially layers 106, 108. More specifically, a first portion of the trusset 110 may be disposed in the first sacrificial layer 106, and a second portion of the trusset 110 may contact the second sacrificial layer 108. The trusset 110 may be formed from various materials including, but not limited to, magnesium and aluminum. In at least one embodiment, the trusset 110 may be formed from a material that matches the molten metal introduced into the mold 102 during the casting process. For example, if molten magnesium is used during the casting process to cast the component, the trusset 110 is also formed from magnesium. Accordingly, the trusset 110 melts in response to contact with the molten metal, thereby forming a homogeneous molecular structure that supports the casted core passage. That is, the molten metal melts the trusset 110, which forms a melted trusset 110' that is integrally formed with the passage wall of the casted core passage.

Referring now to both FIGS. 2 and 3, a trusset 110 included in the casting apparatus 100 will be described in greater detail. The trusset 110 comprises a frame 112 that extends in a direction perpendicular to the second sacrificial layer 108. The frame may be formed from a wire, for example, having a gauge that supports the weight of the second sacrificial layer 108. For example, the frame 112 may have a diameter ranging from about 0.05 inches (1.27 mm) to about 0.20 inches (5.08 mm).

The diameter of the frame 112, however, is not limited to thereto. A first portion of the frame 112 is disposed in the first sacrificial layer 106 and a second portion of the frame 112 contacts the second sacrificial layer 108 via a support region 114 having at least one contact point that supports the second sacrificial layer 108.

Figure 3:
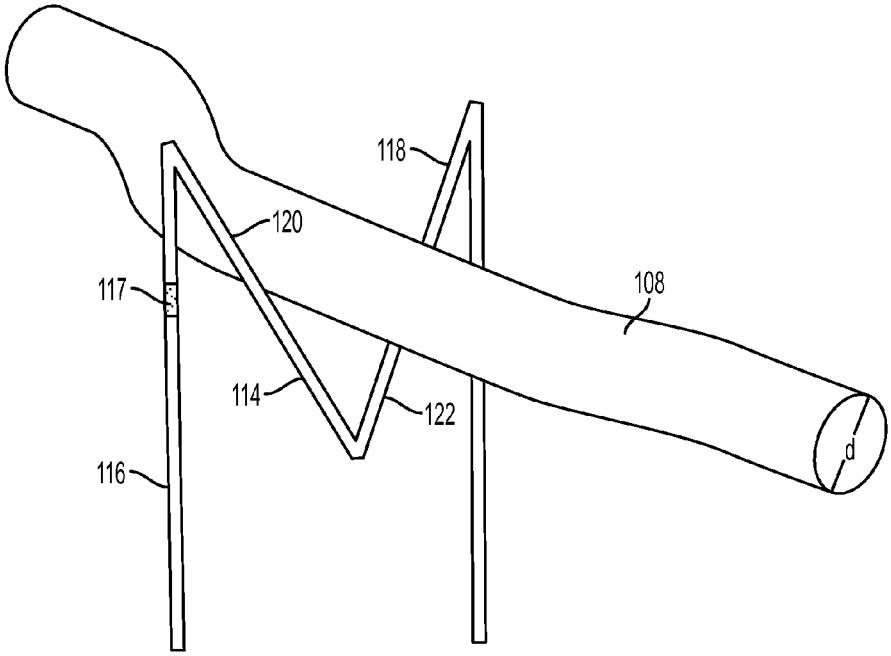
FIG. 3 is an isometric view of the trusset illustrated in FIG. 2 according to an embodiment of the disclosure.

The trusset 110 may have an M-shaped frame 112 having a dual-contact support region 114 as illustrated, for example, in FIGS. 2 and 3. The frame 112 includes first and second support legs 116 to be disposed in the first sacrificial layer 106. Each support leg 116 may include a detachment point 117, which allows the support leg 116 to be detached from the frame 112. The support region 114 includes a first support surface 118 and a second support surface 120. The first support surface 118 extends into the metal fusing area ($A_F$) and contacts the second sacrificial layer 108 at a first area. The second support surface 120 also extends into the metal fusing area ($A_F$) and contacts the second sacrificial layer 108 at a second area different from the first area. The first and second support surfaces 118, 120 contact the second sacrificial layer 108 such that a ventilation region 122 is formed therebeneath. That is, the ventilation region 122 is formed between each of the second sacrificial layer 108, the first contact area 118, and the second contact area 120 to allow gas and/or heat formed during the casting process to escape the second sacrificial layer 108.

Figure 4:
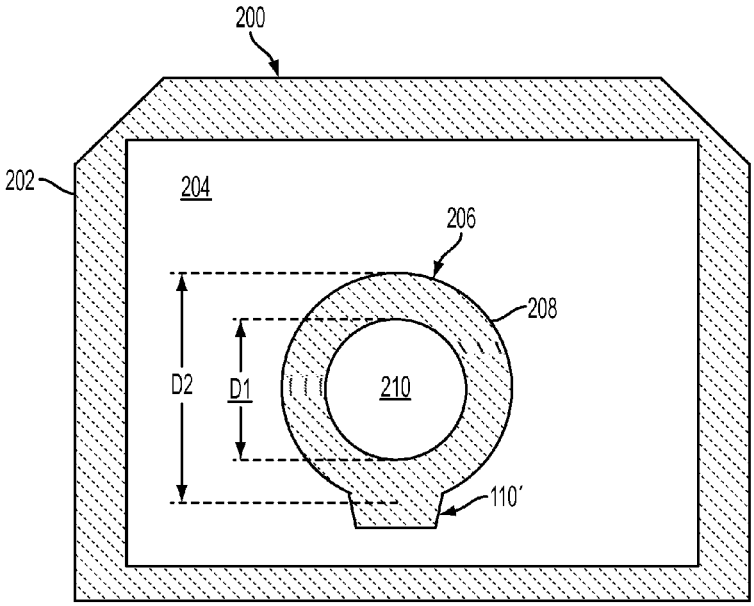
FIG. 4 illustrates the component casting apparatus of FIG. 2 after undergoing a casting process according to an embodiment of the present disclosure.

After the molten metal introduced into the mold 102 is hardened, a casted component 200 is formed as illustrated in FIG. 4. The casted component 200 comprises a housing 202 formed from molten metal. As discussed above, the molten metal breaks down the first sacrificial layer 106 previously disposed in the mold 102. The first sacrificial layer 106 is removed, thereby leaving an interior space 204 having a volume defined by the surface of the housing 202.

A core passage 206 is formed in the interior space 204 using the second sacrificial layer 108, i.e., sand core, as discussed in detail above. More specifically, the core passage 206 includes a passage wall 208 and a hollow region 210 formed therethrough. The hollow region 208 has an inner diameter ($D_1$) defined by the first diameter (D1) of the second sacrificial layer 108, i.e., sand core, which is broken down and removed in response to contact with the molten metal. The passage wall 208 is casted from the same material as the molten metal. As discussed above, the trusset 110 melts in response to contact with the molten metal. Accordingly, a homogeneous molecular structure that supports the casted core passage 206 is formed. That is, the molten metal melts the trusset 110 to form a melted trusset 110' that is integrally formed with the passage wall 208 of the core passage 206. The melted trusset 110' may be noticeable as a raised solid non-hollowed embossing formed on an exterior of the passage wall 208 of the core passage 206 after the component 200 is casted. Moreover, the melted trusset 110' seals the core passage 206 without requiring the conventional core prints utilized in the conventional sand casting process. Since the core prints are eliminated, the need to perform subsequent welding processes required in the conventional casting process is also eliminated.

Figure 5:
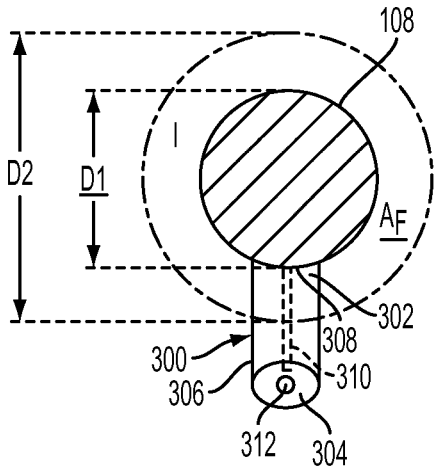
FIG. 5 illustrates a trusset according another embodiment of the disclosure.

Referring now to FIG. 5, a trusset 300 is illustrated according to another embodiment. The trusset 300 extends between an upper end 302 and a lower end 304 to define a single-point frame 306 having a length (L). The length (L) of the single-point frame 306 may be two times (2×) the difference between $D_1$ and $D_2$. i.e., $L=2\times(D_2-D_1)$. For example, if $D_2$=400 cm and $D_1$=300 cm, the length (L) of the frame is 200 cm. The lower end 304 may be disposed in the first sacrificial layer 106 and the upper end 302 may include a support region 308 to contact and support the second sacrificial layer 108 via a single contact point. The single-point frame 306 further includes a vent 310 formed therethrough. The vent 310 extends along a center axis of the single-point frame 306 and between the upper and lower ends 302, 304. The vent 310 is in fluid communication with the first and second sacrificial layers 106, 108. Accordingly, gas and/or heat from the second sacrificial layer 108 may be exhausted to the first sacrificial layer 106 via a vent opening 312 formed at the lower end 304 of the frame 310. By exhausting the gas and/or heat from the second sacrificial layer 108, metal layer defects that may occur during casting of the core passage may be prevented. The vent opening 312 may have a diameter ($D_3$) that is 20 percent the size of the first diameter ($D_1$) of the second sacrificial layer 108. For example, if $D_1$ is 300 centimeters (cm), than $D_3$ is 60 cm.

In light of the above-mentioned embodiments, it is appreciated that at least one embodiment may provide a trusset including a frame that combines the shapes and features of the trusset illustrated in FIG. 3 and FIG. 5. That is, a dual-contact trusset having a V-shaped or a Y-shape may be formed without departing from the scope of the inventive concept described above. Furthermore, a V-shaped and/or Y-shaped trusset may also include a vent formed through a center axis of the frame, which extends between a vent opening formed at a lower end of the frame and a vent region formed near first and second opposing contact areas of an upper portion of the frame.

Figure 6:
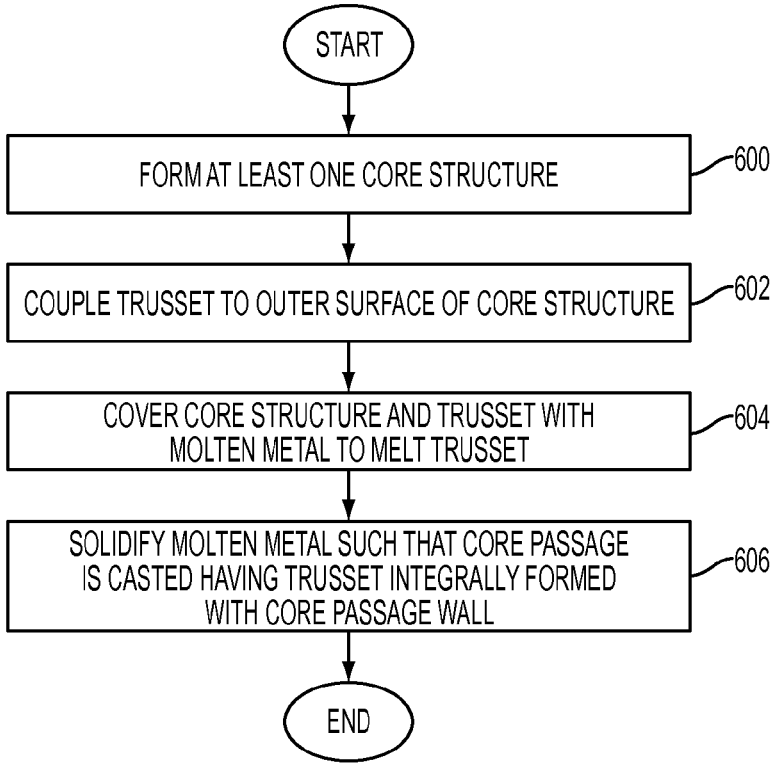
FIG. 6 is a flow diagram illustrating a method of casting a component according to an embodiment of the disclosure.

Referring now to FIG. 6, a flow diagram illustrates a method of casting a component according to an embodiment of the disclosure. At operation 600, at least one core structure is formed having a predetermined diameter for defining a core passage to be casted. The core structure may be, for example, a sand core formed from compressed sand, which is contained in a mold. At operation 602, a trusset is coupled to an outer surface of the core structure. In at least one embodiment, for example, the trusset may include an upper portion coupled to the outer surface of the core structure and a lower portion supported by a sacrificial layer disposed in the mold. At operation 604, the core structure and the trusset are covered with a molten metal. For example, molten magnesium or molten aluminum may be poured into the mold to cover core structure and the trusset. The molten metal takes the form of the core structure, while also melting the trusset. At operation 606, the molten metal is solidified by, for example, cooling the molten metal. Accordingly, a component is formed including a core passage having a hollow region defined by the core structure. Further, the cooling operation results in the melted trusset being integrally formed with an outer surface of the trusset. Accordingly, a homogeneous molecular structure with respect to the outer surface to support of the core passage is formed.

While various embodiments have been described, it should be readily understood that the features are not limited to such disclosed embodiments. Rather, the various embodiments may be modified to incorporate any number of variations, alterations, substitutions or equivalent arrangements not heretofore described, but which are commensurate with the spirit and scope of the inventive concept. Additionally, while various embodiments have been described, it is to be understood that features of the inventive concept may include only some of the described embodiments. Accordingly, the embodiments are not to be seen as limited by the foregoing description, but are only limited by the scope of the appended claims.

What is claimed is:

1. A component casting apparatus, comprising:

a mold to receive a molten material for casting a component, the mold including a first sacrificial layer to define a housing of the component and a second sacrificial layer to form at least one core passage of the component in response to contact from the molten material, the first and second sacrificial layers defining a metal fusing area between one another to receive the molten material and forms a passage wall of the at least one core passage, the second sacrificial layer being surrounded by the first sacrificial layer and extending along a first direction and having a first diameter to define a hollowed region of the at least one core passage of the component in response to contact from the molten material; and a trusset disposed against an outer surface of the second sacrificial layer without extending through the second sacrificial layer, the trusset formed from metal to support the second sacrificial layer, and including a frame extending in a direction perpendicular to the first direction and disposed between the first and second sacrificial layers, the frame including a first portion in contact with the first sacrificial layer and a second portion in contact with the second sacrificial layer, wherein the second portion includes at least one support surface that extends into the metal fusing area and contacts the second sacrificial layer, wherein the frame is a dual-contact frame such that the at least one support surface contacts the second sacrificial layer at two points.

2. The component casting apparatus of claim 1, wherein the trusset is formed from the metal that melts in response to contact from the molten material to form a melted trusset having a homogeneous molecular structure with respect to the molten material to maintain support of the core passage.

3. The component casting apparatus of claim 2, wherein the trusset and the molten material comprise one of magnesium or aluminum.

4. The component casting apparatus of claim 1, wherein the at least one support surface is v-shaped having a first contact area that contact the second sacrificial layer a first point and a second contact area different from the first contact area that contacts the second sacrificial layer at a second contact point different from the first contact point.

5. The component casting apparatus of claim 4, wherein the first contact area, the second contact area and the second sacrificial layer define a ventilation region that exhausts gas from the second sacrificial layer.

6. The component casting apparatus of claim 4, wherein the frame includes a plurality of legs connected to the at least one support surface and separated from each other by a first distance, and wherein the diameter of the second sacrificial layer is less than the first distance.

7. The component casting apparatus of claim 1, wherein the first and second sacrificial layers are formed from sand.

8. A method of casting a component including a core passage, the method comprising:

providing a mold including a first sacrificial layer;

forming at least one core structure having a second sacrificial layer and a predetermined diameter for defining a hollow region of the core passage;

coupling a metal trusset to the second sacrificial layer without extending through the second sacrificial layer;

covering the core structure and the trusset with a molten metal to melt the trusset;

solidifying the molten metal and melted trusset to form the core passage such that trusset is integrally formed thereto, wherein the second sacrificial layer is surrounded by the first sacrificial layer, the second sacrificial layer extending along a first direction, wherein the first and second sacrificial layers define a metal fusing area between one another to receive the molten metal and form a passage wall of the core structure, and wherein the trusset includes a frame extending in a direction perpendicular to the first direction and disposed between the first and second sacrificial layers, the frame including a first portion in contact with the first sacrificial layer and a second portion in contact with the second sacrificial layer, the second portion includes at least one support surface that extends into the metal fusing area and contacts the second sacrificial layer, wherein the frame is a dual-contact frame such that the at least one support surface contacts the second sacrificial layer at two points.

9. The method of claim 8, wherein the trusset is formed as a homogeneous molecular structure with respect to an outer surface of the core passage to support the core passage.

10. The method of claim 9, further comprising forming the trusset and the molten metal from the same metal.

* * * * *